US010017866B2

(12) United States Patent
Yoo et al.

(10) Patent No.: US 10,017,866 B2
(45) Date of Patent: Jul. 10, 2018

(54) APPARATUS FOR SYNTHESIZING AMMONIA

(71) Applicant: KOREA INSTITUTE OF ENERGY RESEARCH, Daejeon (KR)

(72) Inventors: Chung-yul Yoo, Daejeon (KR); Hyung-chul Yoon, Daejeon (KR); Ji-haeng Yu, Daejeon (KR); Jong Hoon Joo, Cheongju-si (KR); Jong-nam Kim, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 348 days.

(21) Appl. No.: 14/871,752

(22) Filed: Sep. 30, 2015

(65) Prior Publication Data

US 2016/0138176 A1 May 19, 2016

(30) Foreign Application Priority Data

Nov. 17, 2014 (KR) ..... 10-2014-0159774

(51) Int. Cl.

| | |
|---|---|
| ***C25B 9/06*** | (2006.01) |
| ***C25B 13/04*** | (2006.01) |
| ***C25B 1/16*** | (2006.01) |
| ***C25B 15/08*** | (2006.01) |
| ***C25B 1/00*** | (2006.01) |
| ***C25B 9/08*** | (2006.01) |
| ***C25B 11/04*** | (2006.01) |
| ***C25B 15/02*** | (2006.01) |

(52) U.S. Cl.

CPC ..... *C25B 15/08* (2013.01); *C25B 1/00* (2013.01); *C25B 9/08* (2013.01); *C25B 11/0447* (2013.01); *C25B 15/02* (2013.01)

(58) Field of Classification Search

CPC .... C25B 1/00; C25B 9/06; C25B 9/08; C25B 11/035; C25B 13/04; C25B 1/16

USPC ..... 205/552

See application file for complete search history.

(56) References Cited

U.S. PATENT DOCUMENTS

| | | | | |
|---|---|---|---|---|
| 7,811,442 | B2 | 10/2010 | Holbrook et al. | |
| 2009/0162721 | A1* | 6/2009 | Naohara | H01M 4/881 429/444 |
| 2011/0302909 | A1* | 12/2011 | Botte | C25B 1/00 60/274 |

FOREIGN PATENT DOCUMENTS

| | | | |
|---|---|---|---|
| EP | 0972855 | A1 | 1/2000 |

* cited by examiner

*Primary Examiner* — Zulmariam Mendez

(74) *Attorney, Agent, or Firm* — Knobbe Martens Olson & Bear LLP

(57) ABSTRACT

The present disclosure relates to an ammonia synthesis apparatus, and more particularly, to an electrochemical ammonia synthesis apparatus using an aqueous solution or a molten liquid of an alkali metal as an electrolyte. According to one or more embodiments, when an aqueous solution or a molten liquid of an alkali metal is used as an electrolyte in an ammonia synthesis apparatus, compositions, sizes, and shapes of an electrode and an electrolyte may be easily controlled, and thus a yield of ammonia synthesis may improve.

6 Claims, 5 Drawing Sheets

[Fig. 1]
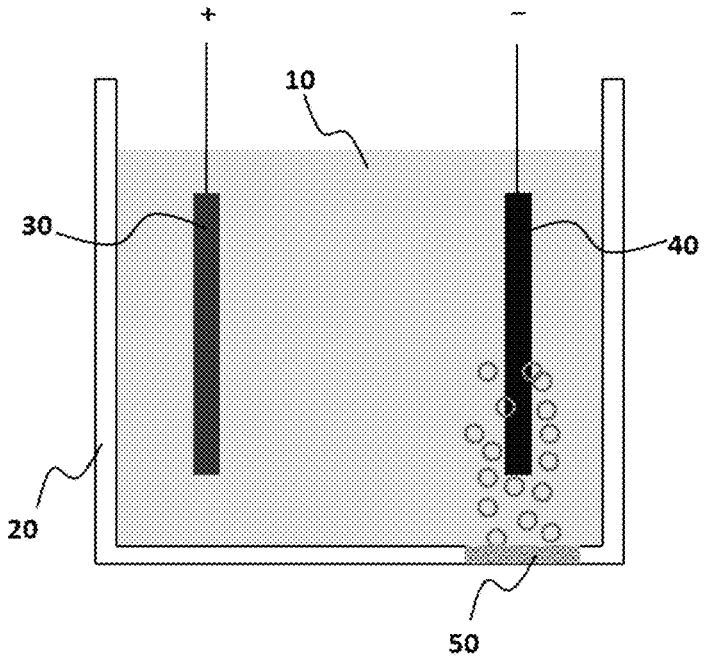
[Fig. 2]
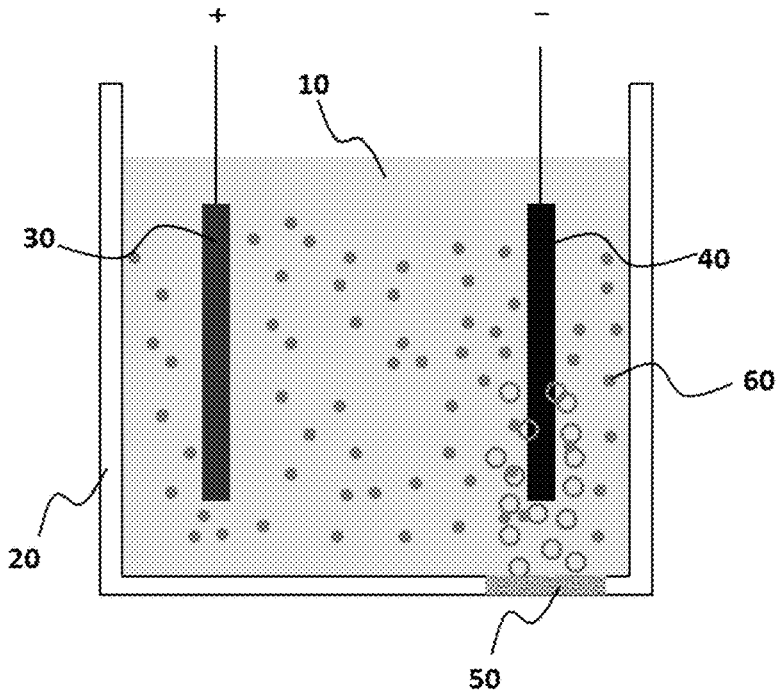

[Fig. 3]
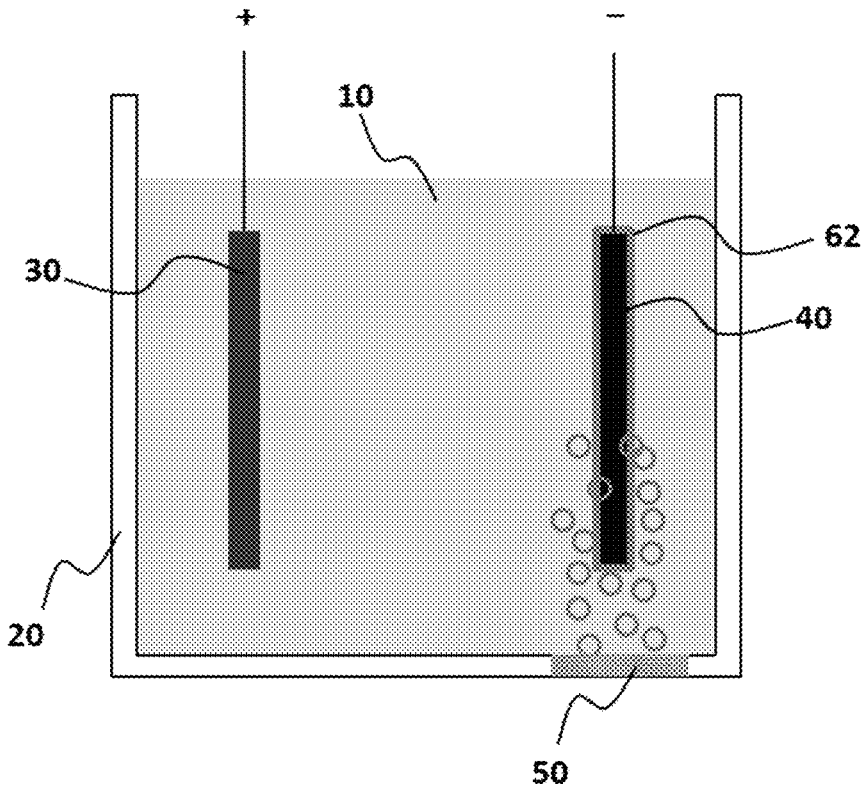

[Fig. 4]
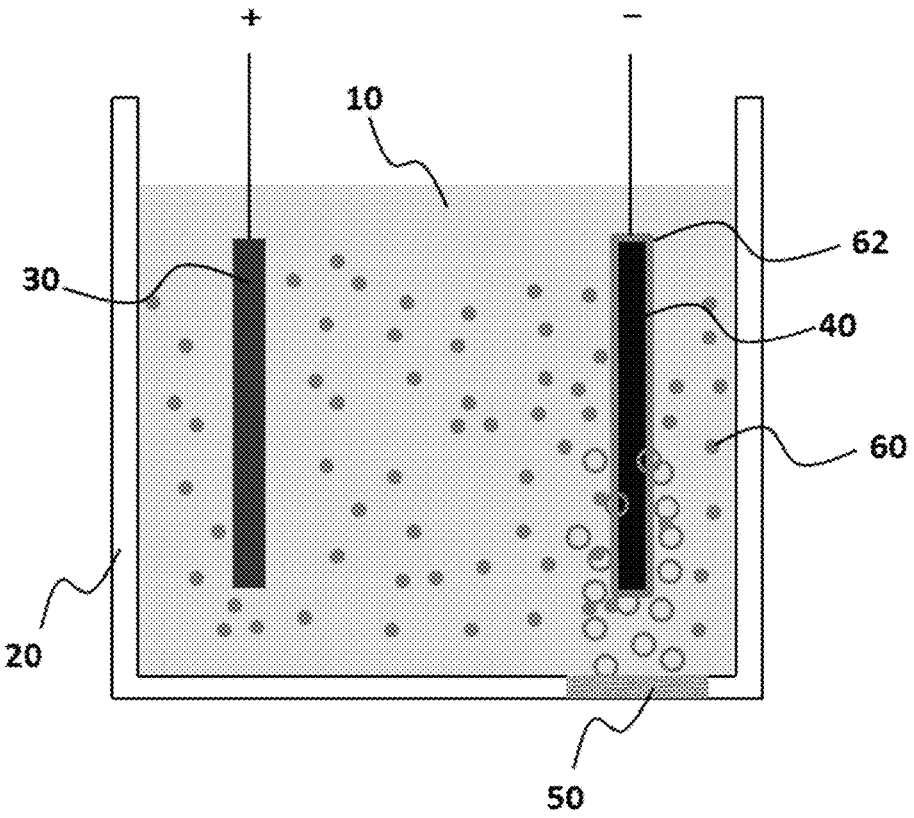

[Fig. 5]
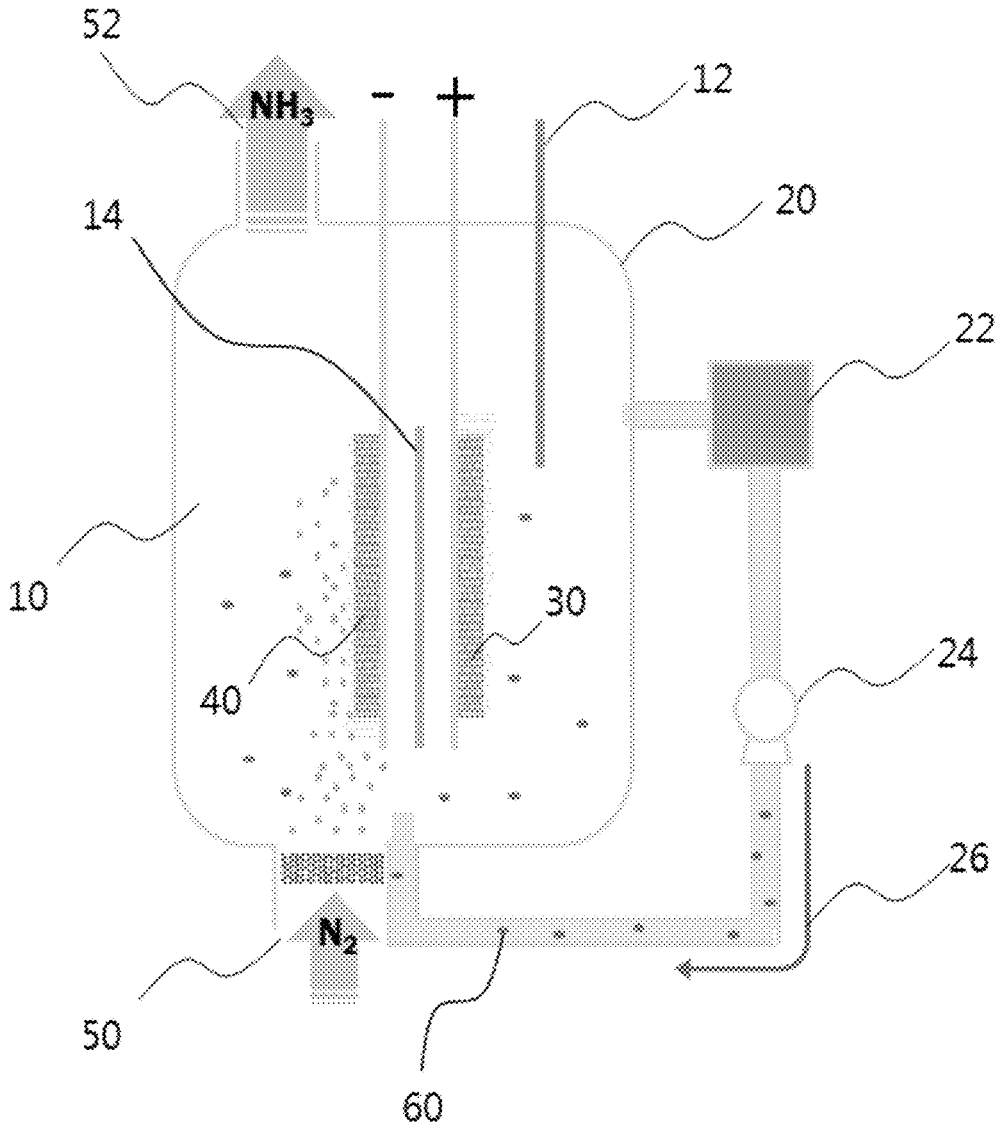

[Fig. 6]
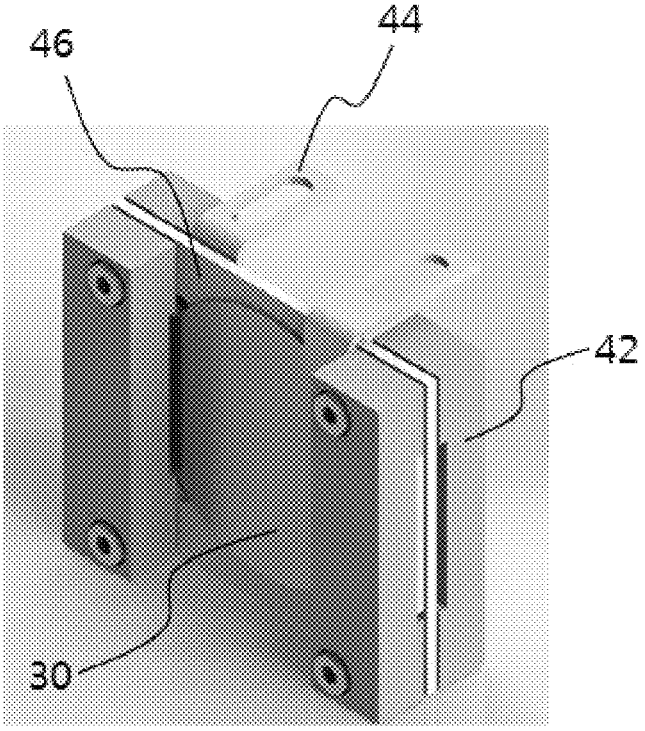

APPARATUS FOR SYNTHESIZING AMMONIA

TECHNICAL FIELD

The present disclosure relates to an ammonia synthesis apparatus, and more particularly, to an electrochemical ammonia synthesis apparatus using an aqueous solution or a molten liquid of an alkali metal, an ionic liquid, or a molten salt as an electrolyte.

BACKGROUND ART

Ammonia is a compound of hydrogen and nitrogen with the formula of $NH_3$. It is a gas with a characteristic pungent smell at room temperature. Ammonia is included at a small amount in the atmosphere, at a trace amount in natural water, and may be produced when bacteria decompose a nitrogen organic matter in the soil.

Ammonia is used as a raw material in various chemical industries, as a raw material for preparing ammonia water, and as a solvent for preparing an ionic material. The most common method for producing ammonia from hydrogen and nitrogen is the Haber-Bosch process, and the process involves an exothermic process that releases 100 kJ of energy as a result of producing two molecules of ammonia by binding one nitrogen molecule and three hydrogen molecules as shown in Formula 1 in the presence of an iron or ruthenium catalyst. However, although this is a large scale industrial process, a yield of ammonia needs to be reduced to 10% to 20%, and the process requires additional energy and hydrogen.

$$N_2+3H_2 \rightarrow 2NH_3+100\ kJ \qquad \text{[Formula 1]}$$

Alternatively, an electrochemical ammonia synthesis method using an ion conductive oxide electrolyte has been suggested. Also, in the method, steam may be used as a source of hydrogen, and the steam may be converted to protons on a surface of the ion conductive oxide and reacted with nitrogen at a low pressure (atmospheric pressure).

U.S. Pat. No. 7,811,442 is related to an ammonia synthesis apparatus for synthesizing ammonia by using a proton conductive solid oxide of a tube type as an electrolyte and supplying an external current.

European Patent No. 0 972 855 is related to an ammonia synthesis apparatus for synthesizing ammonia by using a proton conducting solid oxide of a flat type and supplying an external current.

SUMMARY

One aspect of the present invention provides an electrochemical ammonia synthesis apparatus based on a liquid electrolyte formed of an aqueous solution or a molten liquid of an alkali metal, an ionic liquid, or a molten salt.

The present inventors found that when an improved electrochemical ammonia synthesis apparatus based on a liquid electrolyte formed of an alkaline aqueous solution or a molten salt liquid uses an alkaline aqueous solution or a molten salt liquid as an electrolyte, compositions, sizes, and types of electrodes and an electrolyte may be easily controlled to improve a yield of ammonia synthesis.

One aspect of the present disclosure provides an ammonia synthesis apparatus an aqueous solution or a molten liquid of an alkali metal, an ionic liquid, or a molten salt as an electrolyte, wherein the apparatus includes including an electrolysis cell container; an anode and a cathode that are spaced apart from each other in the electrolyte and are formed of a porous metal; an electrode separation membrane that is located between the anode and the cathode and electrically separates the anode and the cathode; a dry or wet nitrogen supply unit that supplies a dry nitrogen gas or a wet nitrogen gas including steam to the cathode through a porous metal membrane; a power device that is electrically connected with the anode and the cathode and supplies electrical power to the anode and the cathode; a water supply unit that supplies water by measuring an electrolyte level and includes an electrolyte level sensor; and an electrolysis cell container external electrolyte circulation unit comprising a heater that heats an electrolyte discharged through an outlet of the electrolysis cell container and a pump that circulates the electrolyte heated by the heater to an inlet of the electrolysis cell container.

In some embodiments of the apparatus, the alkali may be an alkali metal hydroxide having a formula of AOH. In some embodiments of the apparatus, the alkali may be an alkali earth metal hydroxide having a formula of $AE(OH)_2$, wherein A is an alkali metal that is at least one selected from Li, Na, K, Rb, and Cs, wherein AE is an alkali earth metal that is at least one selected from Mg, Ca, Sr, and Ba.

In some embodiments of the apparatus, the alkali may be a mixture of at least one alkali metal hydroxide and at least one alkali earth metal hydroxide.

In some embodiments of the apparatus, the ionic liquid may be formed of a combination of (i) a cation selected from the group consisting of ammonium, imidazolium, oxazolium, piperidinium, pyrazinium, pyrazolium, pyridazinium, pyridinium, pyrimidinium, pyrrolidinium, pyrrolinium, pyrrolium, thriazolium, and triazolium; and (ii) an anion selected from the group consisting of $F^-$, $Cl^-$, $Br^-$, $I^-$, $NO_3^-$, $N(CN)_2^-$, $BF_4^-$, $ClO_4^-$, $(SCN)^-$, $C(CN)3^-$, $B(CN)_4^-$, $Tf2N^-$, $TfO^-$, $RSO_3^-$, $RCOO^-$ (where, R is a C1-C9 alkyl or phenyl group); $PF_6^-$, $(CF_3)_2PF_4^-$, $(CF_3)_3PF_3^-$, $(CF_3)_4PF_2^-$, $(CF_3)_5PF^-$, $(CF_3)_6P^-$, $(CF_3SO^-)_2$, $(CF_2CF_2SO_3^-)_2$, $(CF_3SO_3)_2N^-$, $CF_3CF_2(CF_3)_2CO^-$, $(CF_3SO_2)_2CH^-$, $(SF_5)_3C^-$, $(CF_3SO_2)_3C^-$, $CF_3(CF_2)_7SO_3^-$, $CF_3CO_2^-$, and $CH_3CO_2^-$.

In some embodiments of the apparatus, the molten salt may include at least one type of a chloride represented by a formula of ACl, wherein A is at least one alkali metal selected from Li, Na, K, Rb, and Cs.

In some embodiments of the apparatus, a material of the anode and the cathode may be an alloy, an oxide, or a nitride formed of at least one selected from Sc, Ti, V, Cr, Mn, Fe, Co, Ni, Cu, Zn Y, Zr, Nb, Mo, Ru, Rh, Pd, Ag, Cd, Hf, Ta, W, Re, Os, Ir, Pt, and Au.

In some embodiments of the apparatus, the electrolyte may further include a nitrogen dissociation catalyst dispersed in the form of nanoparticles having a particle diameter in a range of about 1 nm to about 1000 nm, wherein the nitrogen dissociation catalyst an alloy, an oxide, or a nitride formed of at least one selected from Sc, Ti, V, Cr, Mn, Fe, Co, Ni, Cu, Zn, Y, Zr, Nb, Mo, Ru, Rh, Pd, Ag, Cd, Hf, Ta, W, Re, Os, Ir, Pt, and Au.

In some embodiments of the apparatus, the cathode may be coated with the nitrogen dissociation catalyst on a surface thereof, wherein the nitrogen dissociation catalyst is an alloy, an oxide, or a nitride formed of at least one selected from Sc, Ti, V, Cr, Mn, Fe, Co, Ni, Cu, Zn, Y, Zr, Nb, Mo, Ru, Rh, Pd, Ag, Cd, Hf, Ta, W, Re, Os, Ir, Pt, and Au.

In some embodiments of the apparatus, the electrolyte further comprises the nitrogen dissociation catalyst dispersed in the form of nanoparticles having a particle diameter in a range of about 1 nm to about 1000 nm, wherein the cathode is coated with the nitrogen dissociation catalyst on a surface thereof, wherein the nitrogen dissociation catalyst is an alloy, an oxide, or a nitride formed of at least one selected from Sc, Ti, V, Cr, Mn, Fe, Co, Ni, Cu, Zn, Y, Zr, Nb, Mo, Ru, Rh, Pd, Ag, Cd, Hf, Ta, W, Re, Os, Ir, Pt, and Au.

In some embodiments of the apparatus, a temperature of the heater for heating the electrolyte may be in a range of about 20° C. to about 450° C.

According to one or more embodiments, when an aqueous solution or a molten liquid of an alkali metal, an ionic liquid, or a molten salt is used as an electrolyte in an ammonia synthesis apparatus, compositions, sizes, and shapes of an electrode and an electrolyte may be easily controlled, and thus a yield of ammonia synthesis may improve.

DESCRIPTION OF THE DRAWINGS

FIG. 1 is a schematic view of an ammonia synthesis apparatus according to an embodiment of the present disclosure;

FIG. 2 is a schematic view of an ammonia synthesis apparatus using a nitrogen dissociation catalyst dispersed in an electrolyte, according to an embodiment of the present disclosure;

FIG. 3 is a schematic view of an ammonia synthesis apparatus using a nitrogen dissociation catalyst coated on a reduction electrode, according to an embodiment of the present disclosure;

FIG. 4 is a schematic view of an ammonia synthesis apparatus using a nitrogen dissociation catalyst that is dispersed in an electrolyte and coated on a reduction electrode, according to an embodiment of the present disclosure; and FIG. 5 is a schematic view of an ammonia synthesis apparatus including an electrode separation membrane, an electrolyte level sensor, an electrolyte circulation pump, and a heater.

FIG. 6 is a schematic view of an electrode unit including an electrode separation membrane.

DETAILED DESCRIPTION OF EMBODIMENTS

Hereinafter, embodiments of the inventive concept will be described in detail with reference to the attached drawings.

In an electrochemical ammonia synthesis method, when a solid oxide electrolyte is used, an apparatus needs to be operated at a high temperature, and since ammonia may be decomposed into hydrogen and nitrogen gas at the temperature, ammonia may not be obtained at a high yield. Also, the apparatus needs a complex process of synthesizing and sintering of powder and applying catalyst in the preparation process of the oxide electrolyte, and a sealing membrane requiring heat-treatment of high temperature needs to be used. Therefore, there is a demand for an energy-friendly ammonia synthesis apparatus with a high yield and low manufacturing cost.

Generally, ammonia is a compound of hydrogen and nitrogen with the formula $NH_3$. It is a colorless gas with a characteristic pungent smell at room temperature. Ammonia has a molecular structure including three hydrogen atoms that form an equilateral triangle, where a length of one side of the triangle is 0.163 nm, and a nitrogen atom that is held on a center of the equilateral triangle at a distance of 0.038 nm in the shape of a triangular pyramid. The nitrogen atom in ammonia has one electron lone pair, and thus ammonia may serve as a proton acceptor, that is, a base. The inventive concept is directed to an electrochemical ammonia synthesis apparatus based on a liquid electrolyte. A theoretical electrochemical potential at which hydrogen ions generated during electrolysis of water and nitrogen react to produce ammonia ($N_2+6H^++6e^-\rightarrow 2NH_3$) is 0.057 V vs. a standard hydrogen electrode potential (SHE) which is similar to a hydrogen reduction potential, 0 V. Therefore, an electrochemical method of synthesizing ammonia based on a liquid electrolyte is excellent in terms of energy efficiency. Also, referring to Electrolysis Reaction Scheme 1 below, an equilibrium electrochemical potential at which water and nitrogen react to produce ammonia ($N_2+6H^++6e^-\rightarrow 2NH_3$) in an alkali electrolyte is 1.17 V which is similar to a hydrolysis electrochemical potential, 1.23 V, and thus an ammonia production reaction may be compatible with a hydrogen production reaction. The liquid electrolyte according to an embodiment may be an alkali aqueous solution or an alkali molten salt liquid.

[Electrolysis Reaction Scheme 1]

Cathode: $2N_2+12H_2O+12e^-\rightarrow 4NH_3+12OH^-$ $E_c^0=-0.771$ V (vs. SHE)

Anode: $12OH^-\rightarrow 3O_2+6H_2O+12e^-$ $E_a^0=0.401$ V (vs. SHE)

Overall: $2N_2+6H_2O\rightarrow 4NH_3+3O_2$ $E_{total}^0=1.171$ V (vs. SHE)

Therefore, in some embodiments, the ammonia synthesis apparatus using an alkali aqueous solution as an electrolyte includes an electrolysis cell container that uses an alkali aqueous solution as an electrolyte; an anode and a cathode that are spaced apart from each other in the electrolyte and are each formed of a porous metal; an electrode separation membrane that is disposed between the anode and the cathode to electrically separate the anode and the cathode; a nitrogen supply unit that supplies nitrogen gas to the cathode through a porous metal membrane; a power device that is electrically connected with the anode and the cathode and supplies electrical power to the anode and the cathode; an electrolyte level sensor that measures an electrolyte level; and an electrolysis cell container external electrolyte circulation unit including a heater that heats an electrolyte discharged through an outlet of the electrolysis cell container and a pump that circulates the electrolyte heated by the heater to an inlet of the electrolysis cell container. The alkali aqueous solution refers that the aqueous solution is basic, and, as used herein, the alkali aqueous solution denotes a hydroxide of an alkali metal or an alkali earth metal element. As used herein, the alkali metal hydroxide is represented by a formula, AOH, and the alkali metal hydroxide is represented by a formula, $AE(OH)_2$. "A" in the formulae is at least one alkali metal selected from Li, Na, K, Rb, and Cs, and "AE" in the formulae is at least one alkali earth metal selected from Mg, Ca, Sr, and Ba. In one embodiment, the alkali used as a mixture of at least one alkali metal hydroxide and at least one alkali earth metal hydroxide. Ionic strength of the aqueous solution may be controlled according to a composition of the mixed hydroxides.

Referring to FIG. 1, in the apparatus for synthesizing ammonia by using an alkali electrolyte, an anode 30 and a cathode 40 may be located separate from each other in an electrolysis cell container 20 filled with an alkali electrolyte 10, and a nitrogen supply unit 50 may be located at a lower part of the electrolysis cell container 20. Nitrogen gas is injected to the nitrogen supply unit 50, and, in one embodiment, the nitrogen gas may be injected to the nitrogen supply unit 50 at a pressure in a range of about 1 bar to about 20 bars. Also, the nitrogen supply unit 50 is formed of a porous metal connected to the electrolysis cell container 20 and includes valves that prevent back flow. In the anode 30, a reaction represented by Formula 2 occurs. When hydroxide ions ($OH^-$) in the alkali aqueous solution oxidize at the anode 30, electrons are generated, and the electrons migrate to the cathode 40.

$$12OH^- \rightarrow 3O_2 + 6H_2O + 12e^- \quad \text{[Formula 2]}$$

Nitrogen supplied from the nitrogen supply unit 50 dissociates on a surface of the cathode 40 and reacts with hydrogen ions that are generated at the anode 30 in the electrolyte during hydrolysis to synthesis ammonia in the same manner represented in Formula 3.

$$12H_2O + 2N_2 + 12e^- \rightarrow 4NH_3 + 12OH^- \quad \text{[Formula 3]}$$

The apparatus for synthesizing ammonia by using an alkali aqueous solution electrolyte may easily change composition, size, and capacity of the electrodes and the electrolyte and thus may increase an amount of ammonia synthesis. Also, water supply is not limited, where water is a source of hydrogen needed for synthesis of ammonia, and thus additional supply of vapor is not needed. In one embodiment, a material for the anode and the cathode may be an alloy, a oxide, or a nitride of at least selected from Sc, Ti, V, Cr, Mn, Fe, Co, Ni, Cu, Zn Y, Zr, Nb, Mo, Ru, Rh, Pd, Ag, Cd, Hf, Ta, W, Re, Os, Ir, Pt, and Au.

Nitrogen ($N_2$) is a gas molecule including a triple bond between atoms, and thus the molecule may not be easily dissociated into atoms or ions. Therefore, a catalyst is necessary to promote dissociation of nitrogen. In some embodiments, a nitrogen dissociation catalyst formed of a metal, a metal oxide, and/or a metal nitride that promotes dissociation of nitrogen may be used to increase an amount of synthesis of ammonia. The nitrogen dissociation catalyst may be in the form of nanoparticles or that coats an electrode, and the nitrogen dissociation catalyst in the form of nanoparticles may be expressed as a dispersed floating catalyst, a nano-size catalyst, or a nano-size nitrogen dissociation catalyst. FIG. 2 illustrates that a nitrogen dissociation catalyst 60 serves as a floating catalyst that is dispersed in an alkali aqueous solution electrolyte in the form of nanoparticles. The nitrogen dissociation catalyst 60 dispersed in the electrolyte dissociates nitrogen gas supplied into the electrolyte, and the dissociated nitrogen bonds with hydrogen at the cathode 40. In this regard, ammonia may be synthesized. In some embodiments, for efficient use of a catalyst, ammonia may be synthesized at an interface of the cathode 40, the electrolyte 10, and the nitrogen dissociation catalyst as shown in FIG. 3, where ammonia may be efficiently synthesized by coating the cathode 40 with a nitrogen dissociation catalyst 62. In one embodiment, the nitrogen dissociation catalyst may be coated on a part of or the whole surfaces of the cathode 40 by using brush, spray, screen printing, spin coating, dip coating, electroplating, electroless plating or a hydrothermal method after impregnating the cathode 40 with a precursor solution of the catalyst, but embodiments are not limited thereto. Also, as shown in FIG. 4, ammonia may be synthesized by simultaneously applying the nitrogen dissociation catalyst 60 that is dispersed in the form of nanoparticles and the nitrogen dissociation catalyst 62 coated on the cathode 40 to increase efficiency of ammonia synthesis.

FIG. 5 is a schematic view of an ammonia synthesis apparatus including an electrode separation membrane 46, an electrolyte level sensor 12, an electrolyte circulation pump 24, and a heater 22. An ammonia collecting unit 52 that captures synthesized ammonia is disposed on a top surface of an electrolysis cell container 20, and a nitrogen supply unit 50 is disposed on a lower surface of the electrolysis cell container 20. An electrolyte 10 in the electrolysis cell container 20 flows through the heater 22 and the electrolyte circulation pump 24 that are located outside the electrolysis cell container 20 and connected through a pipe. The heater 22 is used to maintain a temperature of the electrolyte 10 constant, and an example of the heater 22 may be a cartridge heater. The electrolyte circulation pump 24 is equipped in the apparatus to maintain a temperature of the electrolyte 10 and disperse the catalyst, and the electrolyte 10 heated by the heater 22 is supplied to the electrolyte circulation pump 24. The electrolyte 10 is then re-supplied to the electrolysis cell container 20 in a direction of an electrolyte flow 26. This process helps circulation of the nano-size nitrogen dissociation catalyst 60, which is a floating catalyst dispersed in the electrolyte 10, and thus settling of the electrolyte 10 may be prevented, and a catalyst activity may increase, which maximizes a yield of ammonia synthesis. The electrolyte level sensor 12 controls an amount of the electrolyte 10 or water supply to be maintained constant and maintains a constant amount of water, which is a synthesis material of ammonia, in the electrolyte 10. FIG. 6 shows an electrode unit including an electrode separation membrane 46 according to an embodiment of the present inventive concept. The electrode unit includes the electrode separation membrane 46, an electrode connection unit 44, an anode 30, a cathode, and an electrode holder 42. The electrode separation membrane 46 is disposed between the anode 30 and the cathode and may block contact between the anode 30 and the cathode. When an ammonia synthesis apparatus includes the electrode holder 42 and the electrode separation membrane 46, the ammonia synthesis apparatus may be manufactured compactly.

In some embodiments, the nitrogen dissociation catalyst dispersed in the electrolyte may be dispersed in the form of nanoparticles having an average diameter in a range of about 1 nm to about 1000 nm in the electrolyte, but embodiments are not limited thereto. Also, the nitrogen dissociation catalyst may be an alloy, an oxide, or a nitride of at least one selected from Sc, Ti, V, Cr, Mn, Fe, Co, Ni, Cu, Zn, Y, Zr, Nb, Mo, Ru, Rh, Pd, Ag, Cd, Hf, Ta, W, Re, Os, Ir, Pt, and Au.

According to another aspect of an embodiment, an ammonia synthesis apparatus using alkali molten salt liquid as an electrolyte includes an electrolysis cell container filled with an alkali molted liquid as an electrolyte; an anode and a cathode that are located separate from each other in the electrolyte; a vapor mixture nitrogen supply unit that supplies vapor-saturated nitrogen gas to the cathode; and a power device that is electrically connected with and supplies electric power to the anode and the cathode.

In some embodiments, as described above, ammonia may be synthesized by using an electrolytic cell based on a liquid electrolyte, and ammonia may be synthesized by using an alkali molten salt liquid according to an embodiment. Particularly, a eutectic mixture prepared by mixing one or more alkali may be used as a liquid electrolyte. The eutectic mixture is a mixture of at least two different types of crystals that are simultaneously extracted from liquid, where the eutectic mixture has a constant melting point which appears homogenous despite the crystals of at least two different types in a minute size are mixed therein. When a mixture solution of one type is cooled, the mixture solution has a certain freezing point, and solids of a certain composition ratio may be extracted. In this case, when the solids are heated, the solids melt at a temperature same with the freezing point. In this regard, when at least two hydroxides, which are alkali used in an embodiment, are mixed by using the characteristics described above, the hydroxides co-melt at a temperature lower than a melting point of one hydroxide, and thus the mixture solution may be used as an electrolyte at a temperature lower than a melting point of an electrolyte formed of a single hydroxide.

According to another aspect of an embodiment, an ammonia synthesis apparatus using an ionic liquid as an electrolyte includes an electrolysis cell container filled with an ionic liquid as an electrolyte; an anode and a cathode that are located separate from each other in the electrolyte; a vapor mixture nitrogen supply unit that supplies vapor-saturated nitrogen gas to the cathode; and a power device that is electrically connected with and supplies electric power to the anode and the cathode. The ionic liquid denotes an ionic salt that exists in as a liquid at a temperature of about 100° C. or lower, whereas, generally, an ionic salt compound formed of a metal cation and a non-metal anion (e.g., NaCl) melts at a high temperature of about 800° C. or higher. Particularly, an ionic liquid that exists as a liquid at room temperature is referred to as a room temperature ionic liquid (RTIL).

An ionic liquid is non-volatile and thus has no vapor pressure and a high ion conductivity. In particular, an ionic liquid has a high polarity, and thus an inorganic or organic metal compound may be well dissolved in the ionic liquid. Also, an ionic liquid has a unique characteristic of existing as a liquid within a wide temperature range, and thus the ionic liquid may be used in various chemical fields involved with catalyst, dissociation, and electrochemistry. Moreover, an ionic liquid decreases a melting point due to its low molecular symmetry, weak intermolecular force, and charge distribution with respect to cations. Also, an ionic liquid is non-toxic, non-flammable, and excellent in thermal stability, and has appropriate physical and chemical characteristics, such as a wide temperature range for liquid, a high salvation capability, and a non-coordination bonding property, as an environment-friendly next-generation solvent that may alternate a conventional toxic organic solvent. The unique physical and chemical properties of an ionic liquid are influenced by a structure of a cation and an anion of the ionic liquid and may be optimized according to the need of the user.

The ionic liquid used in an embodiment of the present invention is advantageous in terms of increasing a solubility of nitrogen and not being dissociated within a wide range of an applied voltage. Particularly, when the ionic liquid includes an imidazolium-based cation and an anion including nitrile, a nitrogen solubility of the ionic liquid may be high, and thus a nitrogen content in the electrolyte solution may increase, which may result an increase in an amount of nitrogen that participates in ammonia synthesis. In this regard, a yield of ammonia synthesis may increase. In some embodiments, the ionic liquid may include an organic cation and an inorganic anion. For example, the ionic liquid may include (i) a cation selected from the group consisting of ammonium, imidazolium, oxazolium, piperidinium, pyrazinium, pyrazolium, pyridazinium, pyridinium, pyrimidinium, pyrrolidinium, pyrrolinium, pyrrolium, thriazolium, and triazolium, and (ii) an anion selected from the group consisting of $F^-$, $Cl^-$, $Br^-$, $I^-$, $NO_3^-$, $N(CN)_2^-$, $BF_4^-$, $ClO_4^-$, $(SCN)^-$, $C(CN)3^-$, $B(CN)_4^-$, bis(rifluoromethanesulfonyl) imide ($Tf2N^-$), trifluoromethanesulfonate ($TfO^-$), $RSO_3^-$, $RCOO^-$ (where, R is a C1-C9 alkyl or phenyl group), $PF_6^-$, $(CF_3)_2PF_4^-$, $(CF_3)_3PF_3^-$, $(CF_3)_4PF_2^-$, $(CF_3)_5PF^-$, $(CF_3)_6P^-$, $(CF_3SO^-)_2$, $(CF_2CF_2SO_3^-)_2$, $(CF_3SO_3)_2N^-$, $CF_3CF_2(CF_3)_2CO^-$, $(CF_3SO_2)_2CH^-$, $(SF_5)_3C^-$, $(CF_3SO_2)_3C^-$, $CF_3(CF_2)_7SO_3^-$, $CF_3CO_2^-$, and $CH_3CO_2^-$.

The ammonia synthesis apparatus using the ionic liquid as an electrolyte may synthesize ammonia in the same manner as used in the apparatuses shown in FIGS. 1 to 5, but since the ionic liquid does not have water, nitrogen gas is supplied after being saturated with vapor, and hydrogen produced during dissociation of water vapor is used for ammonia synthesis. Also, water may be supplied from the outside through a water supplier, where water is a source of hydrogen for ammonia synthesis. Water supply may be maintained at a constant level by using an electrolyte level sensor, and the electrolyte level sensor may control an amount of water, which is a reactant, at a constant level.

According to another aspect of an embodiment, an ammonia synthesis apparatus may use a molten salt as an electrolyte. The molten salt is prepared by melting a salt, which is a solid at room temperature, at a high temperature. The molten salt used in an embodiment of the present invention may include at least one type of a chloride represented by a formula of ACl, wherein A is at least one alkali metal selected from Li, Na, K, Rb, and Cs. A mixture of at least two types of the chloride is an eutectic mixture, which has an eutectic point that is lower than 450° C.

In some embodiments, an operation temperature of the ammonia synthesis apparatus using an aqueous solution or a molten liquid of an alkali metal, an ionic liquid, or a molten salt as an electrolyte may be in a range of about 25° C. to about 500° C., or, for example, about 20° C. to about 150° C., and thus ammonia may be synthesized at a relatively low temperature. Also, since various compositions of electrodes, types of electrolytes, and nitrogen dissociation catalysts may be controlled and applied, ammonia may be efficiently synthesized by using the ammonia synthesis apparatus. Also, the apparatus may include an electrode separation membrane, an electrolyte level sensor, an electrolyte circulation pump, and a heater.

If not defined otherwise, all terms used herein including technical terms may have the same meanings as those commonly understood by a person of ordinary skill in the art to which the present disclosure pertains. All publications cited herein are hereby incorporated by reference in their entireties.

Hereinafter, one or more embodiments of the inventive concept will be described in detail with reference to the following examples. However, these examples are not intended to limit the scope of the one or more embodiments of the inventive concept.

Example 1: Electrochemical Ammonia Synthesis Using Alkali Aqueous Solution as Electrolyte In order to synthesize ammonia by using the ammonia synthesis apparatus according to an embodiment, an alkali aqueous solution was used as an electrolyte, and the apparatus shown in FIG. 5 was used to synthesize ammonia. Since the electrolyte may be heated and circulated by using a heater and a pump outside the apparatus, and thus optimization of an ammonia synthesize temperature and settling of a floating catalyst in a reactor may be prevented when the floating catalyst is used. 30 wt % of a KOH aqueous solution was used as the alkali aqueous solution, a porous Ni electrode was used as the cathode and the anode, and ammonia was synthesized at a temperature of 60° C. and a pressure of 1 atm. A volume of the electrolysis cell container for ammonia synthesis was 2 liters, and an area of a nitrogen dissociation catalyst for floating was maintained the same at 100 $m^2$ by calculating an area according to a weight of the catalyst from a BET test. The nitrogen dissociation catalyst was a nano-size nitrogen dissociation catalyst, such as $Fe_2O_3$ having a diameter of 300 nm or $CoFe_2O_4$ having a diameter of 100 nm, to measure an amount of synthesized ammonia according to a type of the catalyst. Also, in order to measure an amount of synthesized ammonia when the catalyst coated on the electrode and the nano-size nitrogen dissociation catalyst were simultaneously used, both the anode and the cathode were a porous Ni electrode, and $Co_3O_4$ was coated on a surface of the cathode by a hydrothermal reaction. The nano-size nitrogen dissociation catalyst was $Co_3O_4$ having a diameter of 900 nm to measure an amount of synthesized ammonia. A voltage applied when measuring an amount of synthesized ammonia increased within a range of about 1.5 V to about 2.0 V at an interval of 0.1 V to measure an amount of synthesized ammonia according to voltage change. The results are shown in Table 1.

TABLE 1

| Applied voltage (V) | No floating catalyst ($mol/cm^2 \cdot s$) | $Fe_2O_3$ floating catalyst ($mol/cm^2 \cdot s$) | $CoFe_2O_4$ floating catalyst ($mol/cm^2 \cdot s$) | $Co_3O_4$ floating catalyst and Ni cathode surface coated with $Co_3O_4$ ($mol/cm^2 \cdot s$) | ZrN floating catalyst ($mol/cm^2 \cdot s$) |
|---|---|---|---|---|---|
| 1.5 | $2.84 \times 10^{-11}$ | $6.07 \times 10^{-11}$ | $3.35 \times 10^{-11}$ | $3.90 \times 10^{-11}$ | |
| 1.6 | $3.00 \times 10^{-11}$ | $6.52 \times 10^{-11}$ | $4.46 \times 10^{-11}$ | $5.98 \times 10^{-11}$ | $5.42 \times 10^{-9}$ |
| 1.7 | $3.20 \times 10^{-11}$ | $7.29 \times 10^{-11}$ | $3.73 \times 10^{-11}$ | $5.96 \times 10^{-11}$ | |
| 1.8 | $2.68 \times 10^{-11}$ | $9.56 \times 10^{-11}$ | $6.90 \times 10^{-11}$ | $3.79 \times 10^{-11}$ | $7.66 \times 10^{-9}$ |
| 1.9 | $3.93 \times 10^{-11}$ | $1.10 \times 10^{-10}$ | $7.79 \times 10^{-11}$ | $3.69 \times 10^{-11}$ | |
| 2.0 | $3.84 \times 10^{-11}$ | $1.46 \times 10^{-10}$ | $1.14 \times 10^{-10}$ | $5.32 \times 10^{-11}$ | $1.63 \times 10^{-8}$ |

When $Fe_2O_3$ was used as the nano-size nitrogen dissociation catalyst, the amount of synthesized ammonia was about twice greater than that of the case not including the nano-size nitrogen dissociation catalyst at each applied voltage, and when the applied voltage was 2.0 V, the amount of synthesized ammonia increased about 3.8-fold or more in the case having $Fe_2O_3$ as the nano-size nitrogen dissociation catalyst than the case not including the nano-size nitrogen dissociation catalyst. When $CoFe_2O_4$ was used as the nano-size nitrogen dissociation catalyst, the amount of synthesized ammonia was greater than that of the case not including the nano-size nitrogen dissociation catalyst at each applied voltage, and when the applied voltage was 2.0 V, the amount of synthesized ammonia increased about 2.9-fold or more in the case having $CoFe_2O_4$ as the nano-size nitrogen dissociation catalyst than the case not including the nano-size nitrogen dissociation catalyst. Therefore, it may be confirmed that an amount of synthesized ammonia significantly increases when a nano-size nitrogen dissociation catalyst is dispersed in an electrolyte. Also, it is deemed that when $Fe_2O_3$ is used as a floating catalyst, a catalyst efficiency is higher than the case when $CoFe_2O_4$ is used as a floating catalyst. When a cathode coated with a catalyst and a nano-size nitrogen dissociation catalyst were both used at the same time, the amount of synthesized ammonia did not increase significantly even when an applied voltage was increased. It is deemed that this reduced amount of synthesized ammonia was measured due to $Co_3O_4$ having a diameter of 900 nm as a nano-size nitrogen dissociation catalyst. That is, as a particle diameter of the nano-size nitrogen dissociation catalyst (a floating catalyst) in the electrolyte decreases, the number of catalyst activity site increases, and thus activity of the nitrogen dissociation catalyst and the amount of synthesized ammonia may increase. Also, as a result of using a ZrN nitrogen dissociation catalyst having a high nitrogen affinity, the amount of synthesized ammonia increased about 100 to 1000 folds than when an oxide catalyst is used.

Thus, according to one or more embodiments of the inventive concept, when an aqueous solution or a molten liquid of an alkali metal, an ionic liquid, or a molten salt is used as an electrolyte in an ammonia synthesis apparatus, compositions of electrodes and an electrolyte and a size and a type of a catalyst may be easily controlled, and thus the ammonia synthesis apparatus may increase a yield of ammonia synthesis.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

The invention claimed is:

1. An ammonia synthesis apparatus comprising:

a container;

a liquid composition contained in the container and comprising an electrolyte;

an anode electrode and a cathode electrode that are spaced apart from each other inside the container and contact the liquid composition;

a power supply configured to supply electrical power between the anode electrode and the cathode electrode;

a liquid circulation unit comprising a flow pathway connected to the container and configure to circulate the liquid composition outside the container through the flow pathway; and a nitrogen gas supply configured to supply nitrogen gas to the container, wherein the nitrogen was supply comprises a gas supply inlet formed through a wall of the container below the cathode such that nitrogen gas bubbles are formed and directed to the cathode electrode as nitrogen gas is supplied to the container through the gas supply inlet.

2. The apparatus of claim 1, wherein the liquid composition further comprises catalyst particles dispersed therein.

3. The apparatus of claim 1, wherein the gas supply inlet is formed through a bottom wall of the container immediately below the cathode.

4. The apparatus of claim 1, wherein the flow pathway comprises a liquid inlet formed through a bottom wall of the container.

5. The apparatus of claim 1, wherein the nitrogen gas supply further comprises a valve configured to prevent the liquid composition from flowing into the gas supply inlet.

6. The apparatus of claim 1, wherein the gas supply inlet is formed through a bottom wall of the container immediately below the cathode, wherein the liquid composition further comprises catalyst particles dispersed therein, wherein the flow pathway comprises a liquid inlet formed through the bottom wall of the container next to the gas supply inlet.

* * * * *